United States Patent [19]

Story

[11] 3,960,095

[45] June 1, 1976

[54] AUTOMATIC QUILTING MACHINE

[76] Inventor: Wayne G. Story, 7 Hickory Lane, Algonquin, Ill. 60102

[22] Filed: Mar. 14, 1975

[21] Appl. No.: 558,341

[52] U.S. Cl. ..... 112/118

[51] Int. Cl.[2] ..... D05B 11/00

[58] Field of Search ..... 112/117, 118, 119, 78, 112/90, 93, 102, 103, 121.12, 121.15

[56] References Cited

UNITED STATES PATENTS

| | | | |
|---|---|---|---|
| 3,044,426 | 7/1962 | Schwarzberger | 112/117 |
| 3,354,850 | 11/1967 | Story | 112/118 |
| 3,465,697 | 9/1969 | Gerlach et al. | 112/118 |
| 3,559,600 | 2/1971 | Kalning et al. | 112/118 |

*Primary Examiner*—Geo. V. Larkin

[57] ABSTRACT

An automatic quilting machine for forming a quilted fabric from a plurality of layers of material with a predetermined pattern of stitching, which includes a frame, a workpiece holding carriage mounted on the frame for universal movement, means for moving the carriage, a sewing mechanism, means for applying tension on the material, and means for automatically operating said carriage moving means, said sewing mechanism, and said tensioning means.

13 Claims, 17 Drawing Figures

FIG. 4
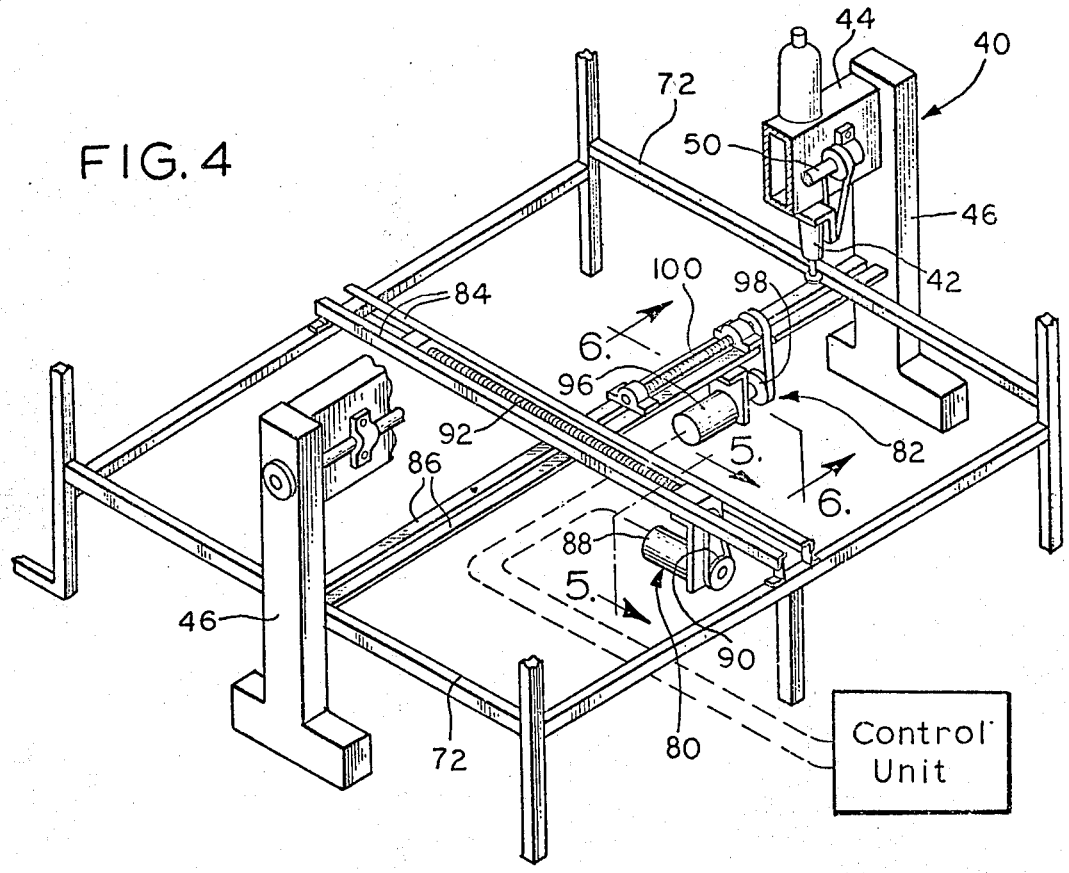
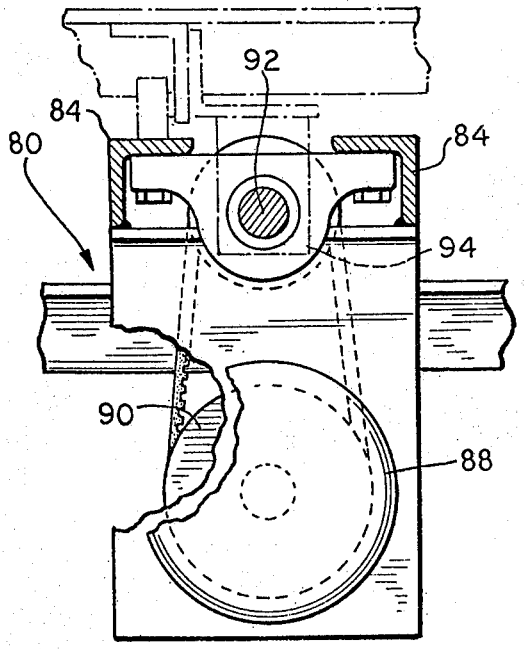
FIG. 5
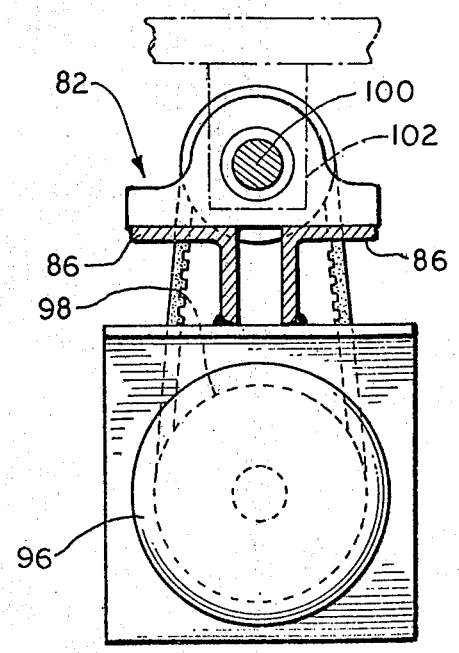
FIG. 6

FIG. 7
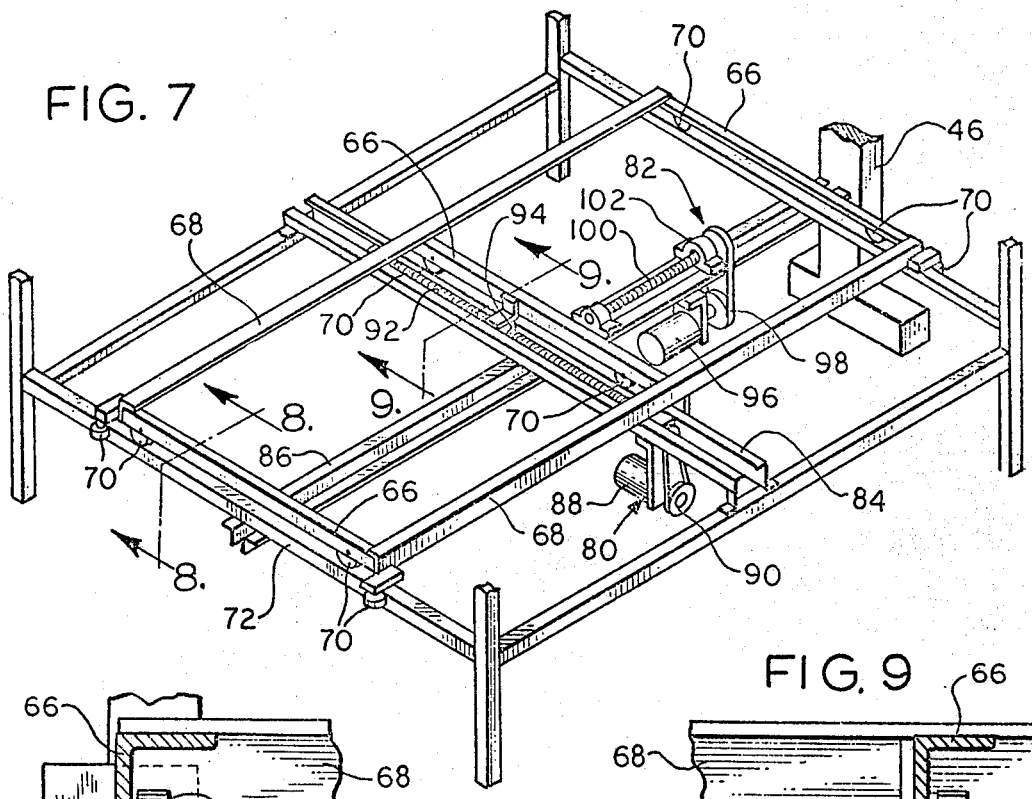
FIG. 9
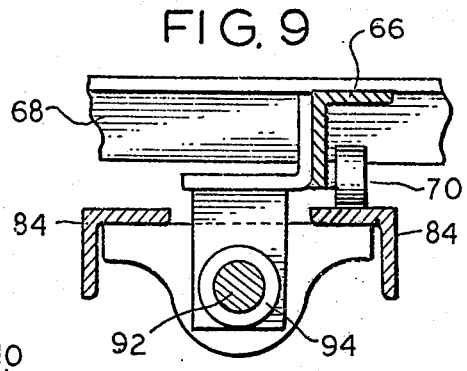
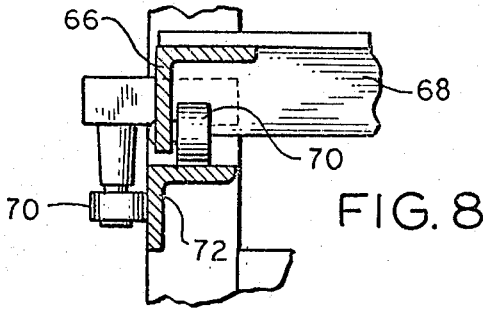
FIG. 8
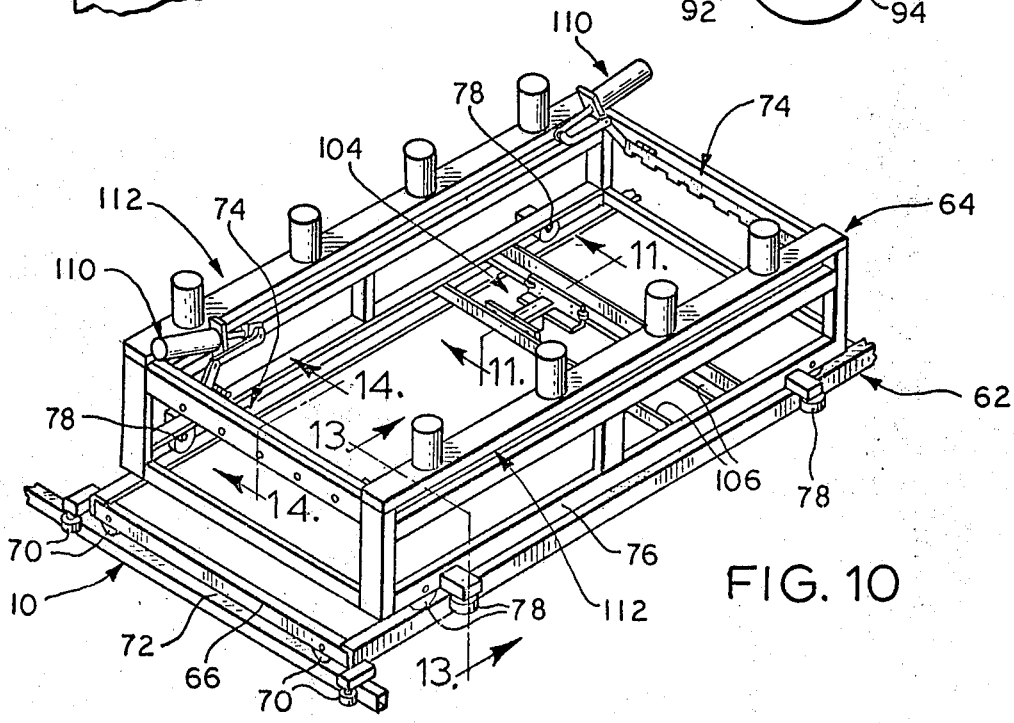
FIG. 10

AUTOMATIC QUILTING MACHINE

BACKGROUND OF THE INVENTION

1. Field of the Invention

The invention relates to automatic quilting machines of the type used to make quilted fabrics such as bedspreads, upholstering materials, and related items.

2. The Prior Art

Although the use of complex cam drive arrangements for quilting machines is well known in the prior art, this invention relates to a fully automatic arrangement wherein the material feeding, holding, and sewing apparatus is controlled by automatic control means to provide an accurate predetermined pattern of stitching. This invention represents an improvement on my earlier U.S. Pat. No. 3,354,850, and permits the continuous automatic formation of quilted fabric units from roll stock.

SUMMARY OF THE INVENTION

It is an object of this invention to provide, in a quilting machine of the type described, automatic means for feeding from roll stock a predetermined length of material layers and combining them with a predetermined pattern of stitching.

A more specific object of the invention is to provide an automatic material feed mechanism and a workpiece holding carriage capable of universal movement for moving the workpiece back and forth under a sewing mechanism, and then automatically repeating the cycle with another section of material from the roll stock.

Another specific object of the invention is the provision of means for automatically grasping, tensioning, clamping, and releasing the material during each sewing cycle.

These and other objects of the invention will be apparent from an examination of the following description and drawings.

THE DRAWINGS

FIG. 4 is a fragmentary perspective view of a portion of the frame structure illustrated in FIG. 1;

Figure 11:
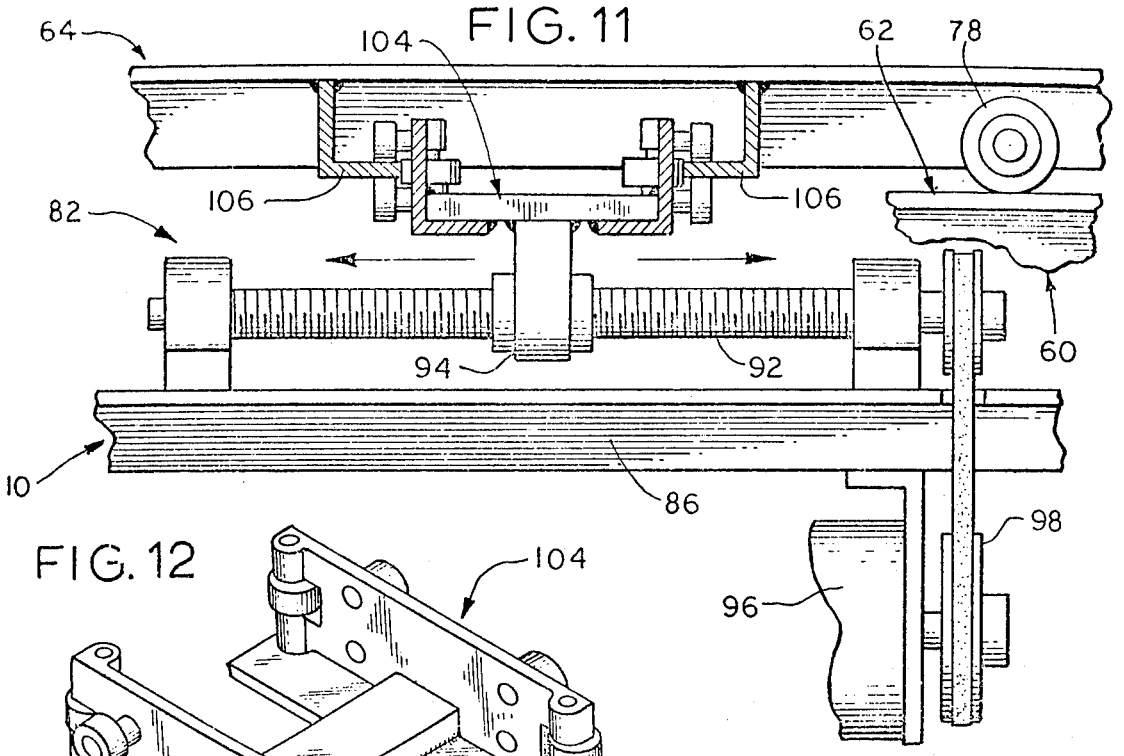
Figure 12:
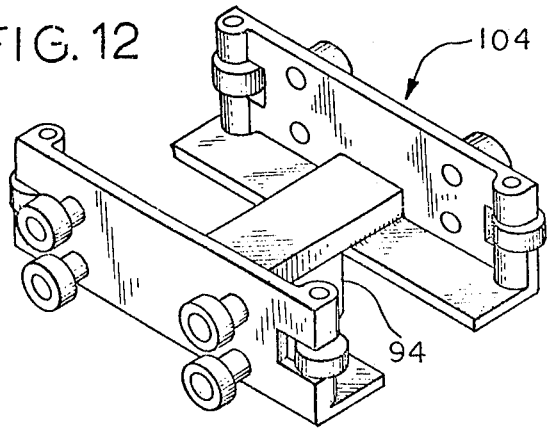
Figure 15:
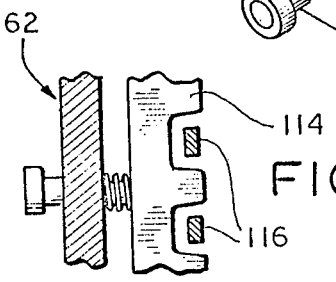
Figure 13A:
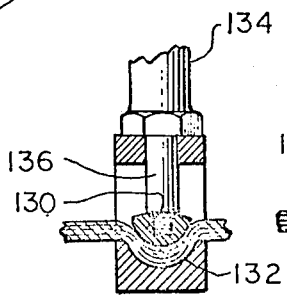
Figure 13:
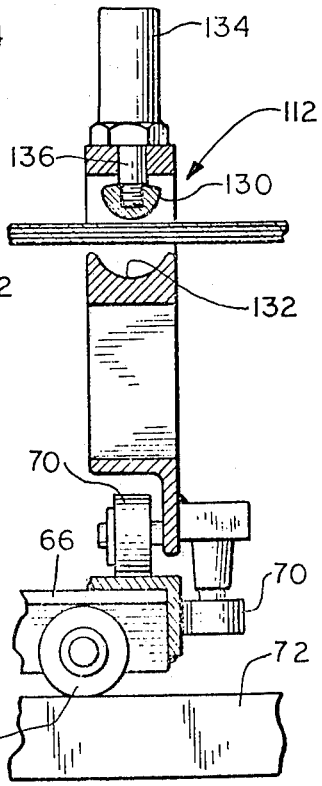
Figure 14A:
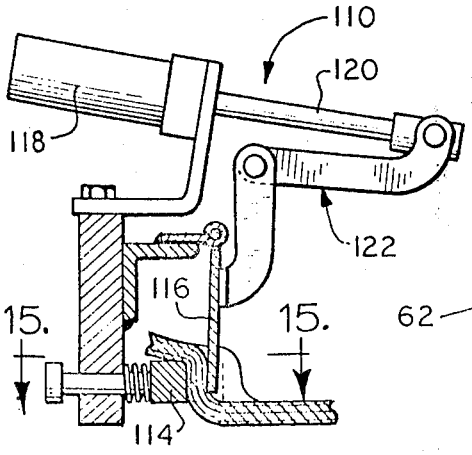
Figure 14:
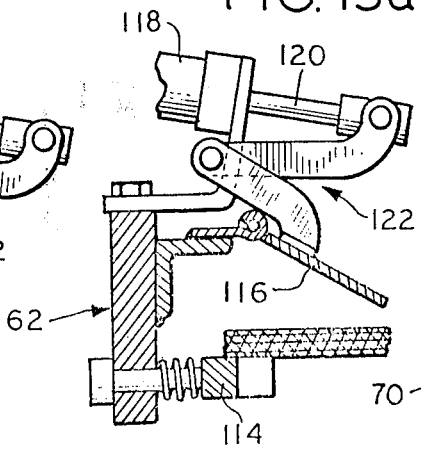

FIGS. 5 and 6 are vertical sections taken on lines 5—5 and 6—6, respectively, of FIG. 4;

FIG. 7 is a view similar to FIG. 4, but with the lower section of the carriage shown in position on the frame;

FIGS. 8 and 9 are vertical sections taken on lines 8—8 and 9—9, respectively, of FIG. 7;

FIG. 10 is a view similar to FIG. 7 but with the upper section of the carriage shown in position on the lower section;

FIG. 11 is a vertical section taken on line 11—11 of FIG. 10;

FIG. 12 is a perspective view of a portion of the drive structure for the carriage upper section;

FIGS. 13 and 14 are vertical sections taken on lines 13—13 and 14—14, respectively, of FIG. 10 and illustrate the clamping mechanisms of the carriage upper section in the open position;

FIGS. 13*a* and 14*a* are views similar to FIGS. 13 and 14, respectively, but illustrate the clamping mechanisms in the closed position; and FIG. 15 is a horizontal section taken on line 15—15 of FIG. 14*a*.

It will be understood that, for purposes of clarity, certain elements may have been intentionally omitted from certain views where they are believed to be illustrated to better advantage in other views.

THE SPECIFICATION

Figure 1:
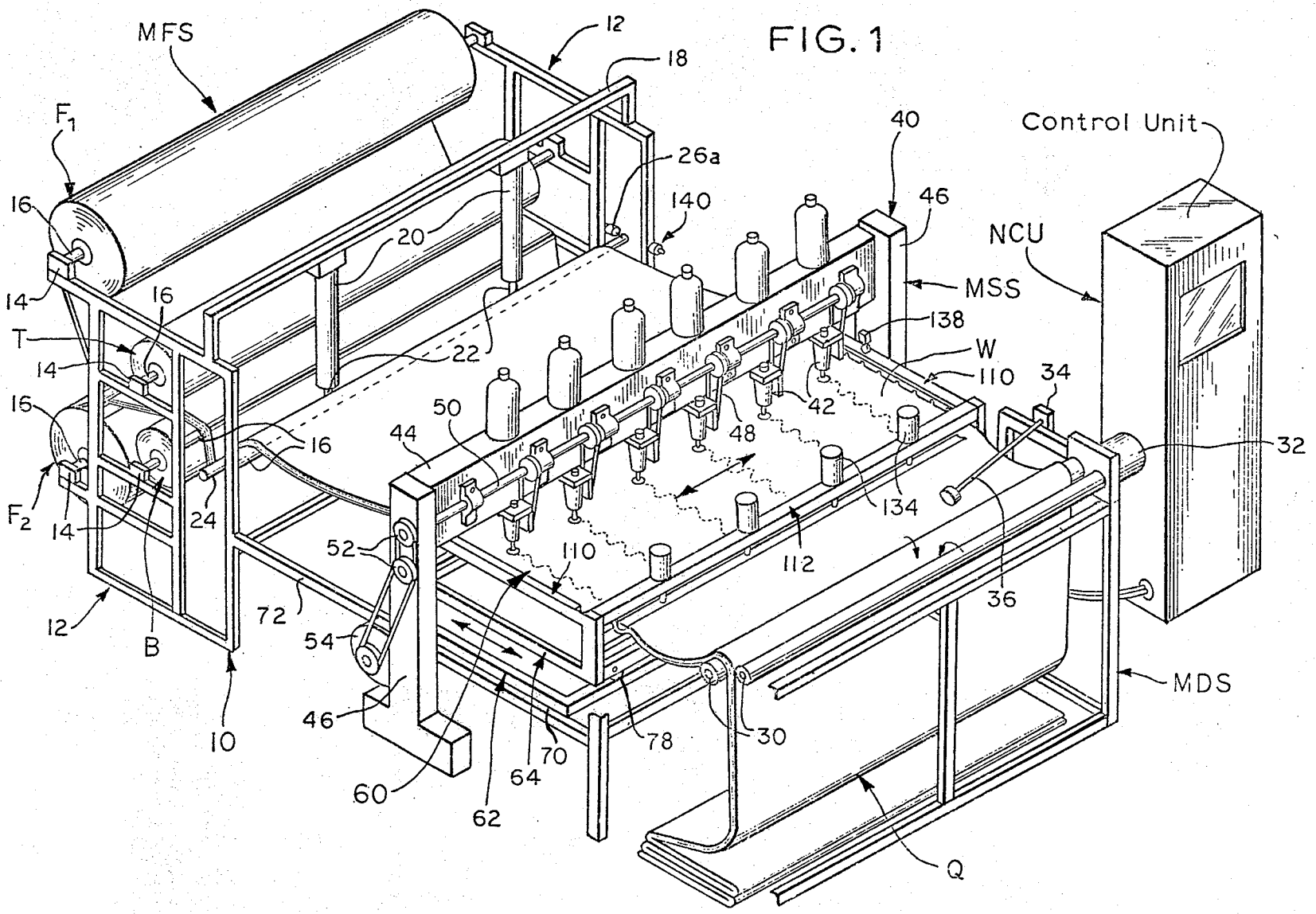
FIG. 1 is a perspective view of a quilting machine embodying features of the invention.

Referring now to the drawings for a better understanding of the invention, and particularly to FIG. 1, it will be seen that there is illustrated therein a quilting machine embodying a preferred form of the invention.

The machine consists essentially of three work areas or stations, as viewed, from left to right in FIG. 1, which are hereinafter referred to as the material feed station MFS, the material sewing station MSS, and the fabric discharge section MDS.

In addition to the structure of the quilting machine there is provided a numerical control unit NCU which may be of conventional design and operation such as that manufactured by Superior Electric Company. Although the control unit is essential to the operation of the quilting machine, as the unit itself is not part of the invention, its structure and operation are not illustrated or described herein.

Extending through all three stations of the machine is a frame 10 which may be mounted on a level surface such as a floor in any desired manner.

Referring now to the left side of the structure shown in FIG. 1, feed station of the machine, it will be seen that frame 10 includes a pair of opposed side sections 12 each including a plurality of journal blocks 14 which receive opposed ends of shafts 16 for supporting rolls of material to be used in forming a quilted fabric Q from a plurality of layers of material. Although various combinations of material may be used, for illustrative purposes there are shown in the drawings four rolls of material: a top liner or facing material T, which may be printed or not, a first filler or padding material F1, a second filler or padding material F2, and a bottom liner or backing material B.

Figure 2:
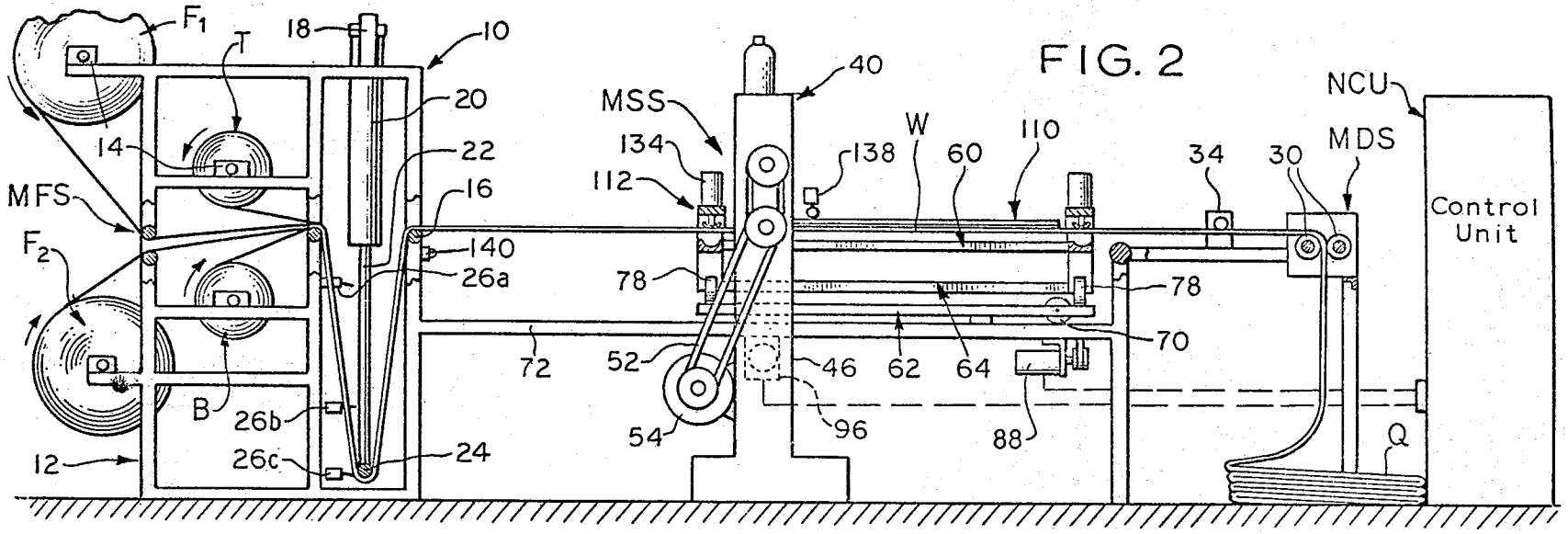
FIGS. 2 and 3 are side elevational views of the structure illustrated in FIG. 1, with the carriage shown in its forwardmost and rearwardmost positions, respectively.
Figure 3:
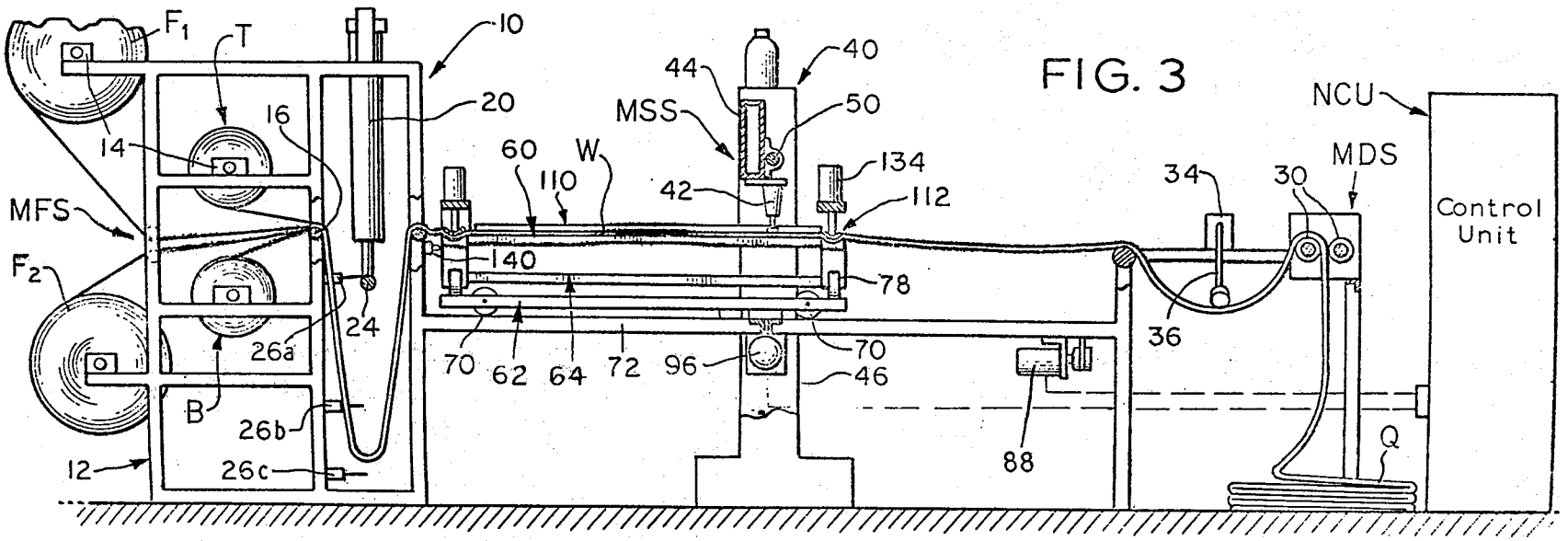

Side sections 12 may be interconnected by a plurality of transverse sections which include a horizontal beam 18 located immediately forward of the shafts 16 and at the upper part of the frame. Mounted on beam 10 and depending therefrom are one or more fluid actuated cylinders 20 having piston rods 22 which are attached to and support a horizontal, transversely extending material gathering and tension rod or bar 24, which in turn is movable up and down in a vertical plane for withdrawing a predetermined length of material from each of the rolls sufficient for forming one complete quilted unit and for maintaining tension on the material so withdrawin in a manner hereinafter described. As best seen in FIGS. 2 and 3, there are mounted on one of the frame side sections 12, adjacent the path of tension bar 24, three vertically spaced limit switches 26*a*, 26*b*, and 26*c* which are engaged or actuated by the tension bar as it moves up and down in a manner hereinafter described.

Referring now to the right side of the structure shown in FIG. 1, the fabric discharge station, it will be seen that a pair of transversely extending slack take-up or tension rollers 30 are carried by the frame. Take-up rollers 30 are driven by a motor 32 mounted on one side of frame 10. Adjacent rollers 30 is a limit switch 34 mounted on one side of frame 10 and having extending therefrom an arm 36 adapted to engage the fabric under certain conditions and actuate limit switch 34 in a manner hereinafter described.

Now referring to the central area of the structure shown in FIG. 1, the material sewing station, it will be seen that there is provided a sewing mechanism indicated generally at 40 which includes a plurality of sewing heads 42 mounted on a transversely extending beam 44 which is supported at its ends by a pair of columns 46 which may be attached to or formed as part of frame 10. Sewing heads 42 may be driven by separate pulleys 48 from a common drive shaft 50 which is carried by beam 44 and which in turn is driven through a pulley mechanism, indicated generally at 52, by a motor 54 mounted on one of the columns 46. Actuation of motor 54 is accomplished through control unit NCU in a manner hereinafter described.

Still referring to the central area of the structure shown in FIG. 1, the material sewing station, it will be seen that there is movably mounted for universal movement a material holding carriage, indicated generally at 60. As best seen in FIG. 10, carriage 60 includes a pair of relatively movable lower and upper members 62 and 64, respectively. Each of the carriage members are generally rectangular structures. Lower member 62 includes opposed pairs of longitudinally and transversely extending elongated elements or rails 66 and 68, respectively. Longitudinally extending rails 66 are provided with roller mechanisms, indicated generally at 70, as seen in FIG. 8, engageable with longitudinally extending elements or rails 72 at opposed sides of frame 10 to permit the carriage lower member to move longitudinally on the frame between the material feed and discharge stations.

Carriage upper member 64 includes a generally rectangular top or material clamping or holding section 74 and a bottom section which has a pair of transversely extending rails 76 which are provided with roller mechanisms, indicated generally at 78 as seen in FIG. 13, engageable with lower member transverse rails 68 to permit the carriage member to move transversely on the lower member back and forth within a limited range of travel.

Movement of the lower and upper carriage members is accomplished by a pair of drive mechanisms 80 and 82 which are mounted on longitudinally and transversely extending beams 84 and 86, respectively, which are part of frame 10 as best seen in FIG. 4.

As best seen in FIG. 5, drive mechanism 80 includes a motor 88 mounted under beam 84 and connected by a pulley 90 to a worm gear or drive screw 92 also mounted on the under side of beam 84 and engageable by a threaded collar nut 94 fixed to and depending from lower member 62.

As best seen in FIG. 6, drive mechanism 82 is somewhat similar and includes a motor 96 mounted under beam 86 and connected by a pulley 98 to a worm gear or drive screw 100 mounted on the upper side of beam 86 and engageable by a threaded collar nut 102.

In order to accommodate the longitudinal movement of upper member 64 with lower member 62 as well as the transverse movement of the upper member relative to the lower member, collar nut 102, as best seen in FIG. 11, is carried by and depends from a bracket 104 which is mounted on the underside of upper member 64 for rolling movement on a pair of rails 106 which extend longitudinally of upper member 64 between its bottom rails 76.

As best seen in FIGS. 1, 10, and 13–15, upper clamp section 74 includes opposed pairs of longitudinally and transversely extending clamping sections 110 and 112 for stretching and holding under tension the side edges and the front and rear edges, respectively, of that portion of the material from the rolls of stock which is to be formed into one unit such as a quilted bedspread, such portion being hereinafter referred to as the workpiece W.

As best seen in FIGS. 14, 14*a*, and 15, the longitudinal clamping sections 110 each include an elongated horizontally disposed, relatively flat, spring loaded bar 114, which is mounted on the inside of clamping section 110 and which has a plurality of spaced teeth adapted to intermesh with related teeth on a plate 116 pivotally mounted for movement into and out of engagement with bar 114 to grasp and retain a marginal portion of workpiece W therebetween, as shown in FIGS. 14 and 14*a*. Plate 116 is actuated by a fluid cylinder 118 having a piston rod 120 connected to plate 116 by a lever mechanism 122. Thus, when cylinder 118 is actuated, plate 116 is moved downwardly and outwardly toward bar 114 trapping the workpiece therebetween. As plate 116 continues to move outwardly, it urges bar 114 to also move outwardly and thereby place tension on the workpiece in a transverse direction and thereby remove any slack therefrom.

As best seen in FIGS. 13 and 13*a*, the transverse clamping sections 112 each include a horizontally disposed, partially rounded bar or rod 130 which is adapted to mate with a recess 132 presented in an upper portion of section 112 to trap and retain a marginal portion of the workpiece therebetween. Vertical movement of the bar is accomplished by one or more fluid cylinders 134 mounted on section 12 and connected to bar 130 by piston rods 136 which extend through aperatures in section 112. Thus, when cylinders 134 are actuated, bar 130 is moved downwardly against recess 132 to clamp the workpiece therebetween and remove some degree of slack which may exist in the workpiece between front and rear transverse clamp sections 112. Most of the slack has been taken out of the workpiece at this stage of the cycle by the tension bar 24 and the take-up rollers 30, as hereinafter described.

Now to describe the operation of the device, as best illustrated in FIGS. 2 and 3, it will be understood that the operation is continuous with one complete quilted bedspread or other unit being formed during each complete cycle of the machine.

After a cycle has been completed and the workpiece holding carriage 60 is at its forwardmost position, FIG. 1, the control unit NCU automatically stops the sewing head motor 54 and the carriage drive motors 88 and 96 according to a program which is predetermined by a tape fed through the control unit.

The control unit then actuates motor 32 causing slack take-up rollers 30 to rotate and pull the forward edge of the fabric therebetween to tighten the fabric in front of the carriage. As the quilted fabric, which is the trailing portion of the previous workpiece, is tightened, it moves upwardly, from the position of FIG. 3 to the position of FIG. 2, and engages arm 36 which actuates limit switch 34 which in turn through relays actuates cylinders 20 causing tension bar 24 to move downwardly from the position of FIG. 3 to the position of FIG. 2.

The downward movement of tension bar 24 against the material stretched between the rolls and the carriage accomplishes two things. First, it pulls off or withdraws from the rolls a measured amount of material which is of sufficient length to form a new workpiece. Second, it places tension on the material between the bar and the rear end of the carriage.

When tension bar 24 reaches its lowermost position, it engages lower limit switch 26c which, through relays, actuates cylinders 118 and 134 causing the clamp sections 110 and 112 to open and release the workpiece, thereby permitting the carriage to move rearwardly without moving the workpiece or the fabric in front of it or the material behind it.

When the clamping sections of the carriage open and release the workpiece, longitudinal clamping section pivot plate 116 engages a limit switch 138, mounted on frame column 46, which actuates the control unit. The control unit then actuates lower carriage member motor 88 causing the carriage to move rearwardly from the position of FIG. 2 to the position of FIG. 3 for the start of a new sewing cycle.

When the carriage reaches its rearwardmost position, control unit NCU then automatically actuates cylinders 118 and 134 which cause the clamping sections 110 and 112 of the carriage upper member to re-engage the material and define a new workpiece. A limit switch 140 on the frame functions as an emergency shut-off if the carriage has not moved completely back to its rearwardmost position. As the clamping sections close, pivot plate 116 is disengaed from limit switch 138 which, through relays, actuates cylinders 20 causing tension bar 24 to move upwardly.

As tension bar 24 moves upwardly, it engages limit switch 26b which actuates motor 32 to reverse rotation of take-up rollers and release tension on fabric in front of carriage.

As tension bar 24 reaches its uppermost position, it engages limit switch 26a which actuates control unit. Control unit then goes through a new cycle, beginning by actuating the sewing head motor 54 and the carriage member drive motors 88 and 96 causing the workpiece to be moved back and forth and laterally under the sewing heads in accordance with a predetermined pattern program to effect the quilting operation.

When the cycle is completed and the carriage again reaches its forwardmost position, the control unit stops all motors and the sequence of events is repeated.

Thus, it will be appreciated that the invention provides a completely automatic quilting operation whereby continuous units of quilted fabric are formed from material in roll stock form with stitching arranged in a predetermined design pattern.

The carriage structure and drive mechanism permit the universal movement of the carriage in accordance with the program of the numerical control unit to provide the desired pattern of stitching.

The material tension bar, the fabric take-up rollers, and the workpiece clamping mechanism of the carriage are all automatically operated and cooperate to permit the carriage to grasp a workpiece, carry it through the sewing operation, and discharge it as a finished product. Without these automatic tensioning and clamping mechanisms, it would not be possible to provide a fully automatic sewing operation with an accurate stitching pattern. The accuracy of the pattern of stitching is dependent upon the absence of slack in the material of the workpiece.

Although the machine embodying the invention is illustrated and described herein in the form of a quilting machine, it is obvious that it is equally suitable for producing embroidered fabrics which are not necessarily quilted.

I claim:

1. In an automatic quilting machine arrangement for continuously forming units of quilted fabric, such as bedspreads or the like, by sewing together a plurality of layers of different material from roll stock with a predetermined pattern design of stitching, the combination of:

a. a frame including:
   i. a material feed station;
   ii. a material sewing station;
   iii. a fabric discharge station;
b. material supporting means on said frame at said feed station for supporting a plurality of rolls of material to be quilted;
c. material feed means on said frame at said feed station for withdrawing from said rolls a predetermined length of material stock sufficient for forming one unit of quilted fabric and also for maintaining tension on said material rearwardly of said sewing station;
d. slack take-up means on said frame at said discharge station for maintaining tension on said material forwardly of said sewing station;
e. at least one sewing mechanism on said frame at said sewing station;
f. a material holding carriage mounted for universal movement on said frame at said sewing station adjacent said sewing mechanism and including:
   i. a lower carriage section mounted on said frame for movement longitudinally thereof between said feed and discharge stations;
   ii. an upper carriage section mounted on said lower carriage section for movement transversely thereof;
   iii. said upper carriage section including means for clamping under tension a section of said material to be quilted;
g. separate motor drive means for moving each of said carriage sections relative to each other and to said frame;
h. control means for operating said motor drive means whereby the lower and upper sections of said carriage are moved longitudinally and transversely of the frame, respectively, so that said sewing mechanism will form a predetermined pattern of stitching.

2. In an automatic sewing machine arrangement for continuously forming units of quilted fabric, such as bedspreads or the like, by sewing one or more layers of material from roll stock with a predetermined pattern of stitching, the combination of:

a. a frame for holding said rolls of material;
b. a sewing mechanism;
c. a material holding carriage mounted on said frame adjacent said sewing mechanism for universal movement relative to said frame;
d. said carriage including clamp means for gripping said material;
e. means for moving said carriage in a predetermined path to provide a predetermined pattern of stitching;

f. means for applying tension on said material at locations spaced rearwardly and forwardly of said carriage to maintain said material in position when said carriage clamp means are not engaged with said material and said carriage is moved relative to said material.

3. An arrangement according to claim 2, wherein said carriage includes:

a. a lower section movable longitudinally on said frame;

b. an upper section movable transversely on said upper section;

c. means interconnecting said carriage sections accommodating their movement both with and relative to each other at the same time.

4. An arrangement according to claim 3, wherein said carriage moving means includes separate drive mechanisms for each carriage section, each drive mechanism comprising:

a. a motor driven screw mounted on said frame;

b. a threaded collar carried by a carriage section for engagement with said screw.

5. An arrangement according to claim 4, wherein the threaded collar of the drive mechanism of said upper carriage section is mounted thereon for movement relative thereto in a direction normal to the direction said upper carriage section is moved by its related drive mechanism.

6. An arrangement according to claim 2, wherein said clamp means includes opposed pairs of elongated clamping mechanisms for gripping marginal portions of said material and applying tension thereto as they are gripping said material to remove slack therefrom.

7. An arrangement according to claim 6, wherein said one of said clamping mechanisms includes:

a. a spring loaded first element mounted for reciprocal movement in one plane;

b. a second element mounted for pivotal movement toward and away from said first element for gripping said material therebetween;

c. means for moving said second element relative to said first element.

8. An arrangement according to claim 6, wherein one of said clamping mechanisms includes:

a. a first element having a recess extending lengthwise thereof;

b. a second element contoured to mate with the recess of said first element;

c. means for moving said second element relative to said first element.

9. An arrangement according to claim 6, wherein said clamping mechanisms are operated by fluid actuated cylinders.

10. An arrangement according to claim 7, wherein said first and second elements have complementary, intermeshing edges.

11. An arrangement according to claim 2, wherein one of said tension applying means includes a pair of motor driven elongated rollers carried on said frame forwardly of said carriage.

12. An arrangement according to claim 2, wherein said tension applying means includes an elongated bar mounted for reciprocal movement in a generally vertical plane and operable to withdraw from said roll stock a predetermined length of material sufficient to form one unit of quilted fabric.

13. An arrangement according to claim 2, wherein the operations of said sewing mechanism, said carriage clamp means, said carriage moving means, and said tension applying means are controlled by a predetermined program in a numerical control unit.

* * * * *